United States Patent [19]

Jordan et al.

[11] Patent Number: 4,682,381

[45] Date of Patent: Jul. 28, 1987

[54] SPIKE FORMING METHOD

[75] Inventors: Chalmer Jordan, Saegertown; Lee Connor; Robert Lybarger, both of Meadville, all of Pa.

[73] Assignee: Saegertown Manufacturing Corporation, Saegertown, Pa.

[21] Appl. No.: 824,502

[22] Filed: Jan. 31, 1986

[51] Int. Cl.[4] ..... B21K 1/44; B21G 3/00

[52] U.S. Cl. ..... 10/63; 10/27 R

[58] Field of Search ..... 10/10 R, 24, 27 R, 27 E, 10/56, 57, 61, 62, 63; 411/378, 424

[56] References Cited

U.S. PATENT DOCUMENTS

| | | | |
|---|---|---|---|
| 1,255,504 | 2/1918 | Blakeslee | 10/27 R |
| 2,024,070 | 12/1935 | Sharp | 411/424 X |
| 3,072,933 | 1/1963 | Carlson | 10/27 E |
| 3,247,534 | 4/1966 | McClellan | 10/27 E |
| 4,586,231 | 5/1986 | Powderly et al. | 10/27 E |

FOREIGN PATENT DOCUMENTS

| | | | |
|---|---|---|---|
| 259585 | 7/1928 | Italy | 10/27 R |
| 20483 | of 1909 | United Kingdom | 10/10 R |

*Primary Examiner*—E. Michael Combs

*Attorney, Agent, or Firm*—Parkhurst & Oliff

[57] ABSTRACT

The present invention relates to a method for forming a blank railroad spike using a series of cold forming dies. A workpiece is introduced into a first die to form a first stage spike having a squared end and a thick cylindrical shank. The first stage spike is introduced into a second cold forming die to form a second stage spike in which a lower portion of the shank is decreased in diameter, while a upper portion of the shank maintains the same diameter as in the first stage spike. The second stage spike is introduced into a third cold forming die to form a third stage spike in which the upper portion of the shank is compressed to form a collar for the spike. The blank spike is subsequently introduced into a thread cutting apparatus to form the finished threaded spike.

15 Claims, 9 Drawing Figures

SPIKE FORMING METHOD

BACKGROUND AND SUMMARY OF THE INVENTION

1. Field of the Invention

The present invention relates to a method for forming a blank spike which is cut with threads after its formation. More particularly, the present invention relates to an efficient, accurate and economical method for forming a blank railroad spike using a series of cold forming dies.

2. Description of Related Art

Railroad spikes are used to fasten a rail to a wooden tie. An efficient method must be provided to manufacture economically the enormous number of spikes necessary for construction or repair of a railraod.

A commonly used railroad spike is known as the "Tirefond" or "North American" spike screw which is illustrated in FIG. 3. In its finished state, the spike has a shank 12 with a cylindrical portion 14 and a tapered portion 16 which decreases in diameter towards the tip of the spike. The shank is cut with a particular thread arrangement which cooperates with the tapered portion to firmly grip the wooden tie and prevent pull-out. The head 10 of the spike is provided with a squared end that receives a tool for screwing the threaded spike into the tie. When fully screwed into the tie, a collar 18 located below the squared end caps the screw hole to prevent ingress of water or other corrosives. Such a railroad spike is illustrated in U.S. Pat. No. 4,278,374.

One method of forming the "Tirefond" or "North American" spike is by a hot forging and rolling process in which a heated cylindrical bar is inserted between rotating drums to form the spike with the squared head collar, tapered shank and threads. For example, see British Patent Specification No. 757,709, filed May 12, 1953. However, this process is cumbersome and expensive, as well as being unreliable in terms of the accuracy and precision of the dimensions of the spike and thread.

As an alternative to hot forging and rolling, a blank or unthreaded spike is first formed with a squared end, collar and cylindrical shank. The blank spike is subsequently cut by a milling operation to form a tapered shank with threads. A milling apparatus for tapering the shank and cutting the thread is disclosed in U.S. Pat. No. 4,278,374. Alternatively, a device employing tangential chasers to cut a thread on a blank railroad spike may be employed as disclosed in the above-identified related application.

Regardless of the device used to cut the thread on a blank spike, the formation of an accurate, unblemished blank spike is critical to the economical manufacturing of the finished spike, since it is useless to cut a thread on a defective or faulty blank spike. The present invention is directed to the economical manufacture of a blank spike.

One such known process for forming a blank spike is illustrated in FIGS. 1A–1D. In that method, a wire is drawn to an initial diameter (preferably about 0.907 inches) and passed through a cut-off station which cuts the wire into sections of approximately 7 inches. In FIG. 1A, the wire section is introduced into a first die in which a punch upsets or "bumps up" the top of the wire to increase its diameter to preferably about 1.111 inches. The first die forms a first stage spike having a shank 20 and a head 22. The head 22 includes a tapered portion 24 which is formed by compression of the wire by the punch. The diameter of the tapered portion increases between the shank and the top of the head 22. Preferably, the initial diameter of the shank is not affected by the punch and therefore remains at about 0.907 inches.

The first stage spike of FIG. 1A is introduced into a second die to form a second stage spike illustrated in FIG. 1B. In the second stage spike, a punch upsets the head 22 and tapered portion 24 to form a rough squared end 30 and a bulge section 32 beneath the squared end 30. In other words, the squared end 30 is formed by "bumping up" the top of the first stage spike. The squared end 30 has rounded edges which must be smoothed into corners so that a tool can be applied to the spike. The bulge section 32 has a diameter equal to that of the tapered portion of the first stage spike (i.e., 1.111 inches). The initial diameter of the shank is a not appreciably modified by the second die, but may be upset to about 0.912 inches.

The second stage spike is introduced into a third die to form the third stage spike illustrated in FIG. 1C. In the third stage, the bulge section is compressed to form a collar 40. Preferably, the diameter of the collar 40 is approximately two inches. In addition, the third die smoothes the squared end 30 to form corners for the tool, while forming a depression 42 in the squared end and an underfill area 44 at the lower tip of the shank. After forming the third stage spike, the spike may be introduced into a fourth die (FIG. 1D) which provides a recess 46 in the base of the shank for the holding the blank spike during the thread forming operation.

This known method has a major disadvantage. In forming the blank spike, the top end of the wire is first built-up to form the rough squared end and bulge section, thereby resulting in a significant amount of metal movement which creates fatigue in the spike. The bulge section then is compressed to form the collar while the squared end is smoothed. The head and collar area are overworked by the build-up and compression so that tensile ruptures, stress cracks and other fractures may form therein. For example, upsetting the wire from its initial diameter (e.g., 0.907 inches) to the diameter of the collar (e.g., 2.0 inches) usually exceeds the ability of the material to deform in about 33% of all spikes. In addition, even the portions of the spike that have not been ruptured still show indications that the material has been severly overworked. The overworking of the material results in an unsightly or blemished spike.

In view of the foregoing, only an average of about 65% of the spikes formed in accordance with the above-described method are acceptable for the thread forming operation. Such a low percentage is extremely uneconomical when manufacturing enormous numbers of spikes.

It is an object of the present invention to obviate the above-described disadvantage by providing an economical spike forming method which has an average acceptance percentage of about 90–95%.

Another object of the present invention is to provide a spike forming method which does not overwork the material in order to form the squared end and collar.

It is a further object of the present invention to provide a spike forming method which provides better head and collar formation by inhibiting the formation of ruptures, cracks and fractures.

In accordance with the presently claimed invention, a method is provided for forming a cylindrical workpiece having a first diameter into a blank spike which is subsequently provided with threads. The method includes the steps of introducing the workpiece into a first die to form a first stage spike having a cylindrical shank and a tool receiving end. The shank of the first stage spike has upper and lower portions of a first diameter which is equal to the diameter of the cylindrical workpiece. The first stage spike is introduced into a second die to form a second stage spike. The second die reduces the lower portion of the shank of the first stage spike to a second diameter which is less than the first diameter of the upper portion of the shank. The second stage spike is introduced into a third die to form the third stage spike. In the third stage, the upper portion of the shank of the second stage spike is compressed to form a collar between the tool receiving end and the lower portion of the shank.

The inventive method for forming a spike provides significant advantages over the known method. In the inventive method, the upper portion of the first stage spike has a diameter sufficient to form the squared head without being "bumped up". Thus, the upper portion of the first stage spike does not need to be upset to increase its diameter thereby resulting in less metal movement and less working of the material. In addition, the first die forms the first stage spike with a tool receiving end which is substantially the same as the tool receiving end of the finished blank spike. Accordingly, the upper portion of the shank and the tool receiving end are not overworked so that the formation of cracks and/or fractures are inhibited.

BRIEF DESCRIPTION OF THE DRAWINGS

The invention will be described in detail hereinafter with reference to the appended drawings in which like elements bear like reference numerals and wherein.

DETAILED DESCRIPTION OF THE PREFERRED EMBODIMENT

The invention will be described herein with reference to a spike having preferred dimensions. These dimensions are not meant to be limiting, but rather are illustrative of a preferred embodiment of the invention. Variations and changes in the dimensions are possible without departing from the scope of the invention.

In accordance with the invention illustrated in FIGS. 2A–2D, a blank spike is formed by introducing the spike into a series of cold forming dies. Each die forms a different stage of the spike. The dies are not illustrated in detail in FIGS. 2A–2D. However, the dies have a shape corresponding to the shape of the spike illustrated in the particular die. Those skilled in the art may thus readily determine the shape of the die from the shape of the spike produced in that die. The line F in FIGS. 2A–2D represents the face of the dies.

Figure 2B:
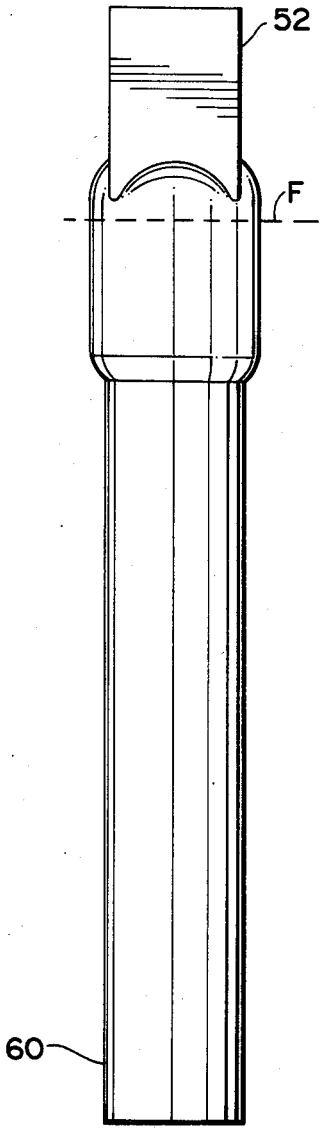
FIGS. 2A–2D are views of the blank spike at different stages in the spike forming process in accordance with the present invention.
Figure 2A:
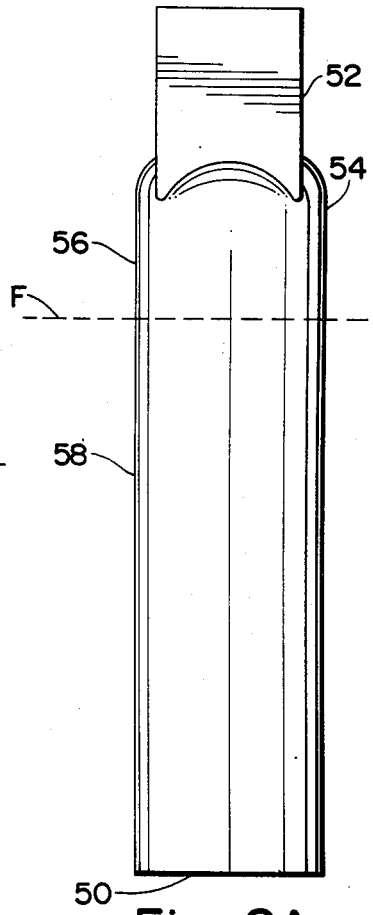

A first stage spike 50 is formed by introducing a wire having a diameter of about 1.117 inches into a first die to produce the first stage spike illustrated in FIG. 2A. The wire size is selected by determining the desired "across corner" dimension of the finished squared end of the spike, but must be no larger than the dimension that prevents the shank of the spike from being extruded from the dies. In the preferred embodiment, a diameter of about 1.117 inches is a maximum practical wire size which achieves both the desired "across corner" dimensions, and prevents the shank from being trapped within the dies. In addition, maximizing the wire size minimizes the amount of the cold working during subsequent formation of the collar.

In the first die, a punch is applied to the top of the wire so that the first stage spike is provided with a squared head 52 and a cylindrical shank 54. The punch forms the squared head 52 in essesntially its finished state so that it need not be significantly modified by subsequent dies. The squared head 52 has a width of preferrably about 0.825 inches and a height of preferably about 0.905 inches. The shank 54 is unaffected by the punch and maintains its diameter of preferably about 1.117 inches. When placed in the die, the shank 54 includes an upper portion 56 above the face F of the die and a lower portion 58 below the face F. The diameter of the upper and lower portions 56, 58 is approximately the same (e.g., about 1.117 inches). The upper portion 56 of the shank is the portion which eventually forms the collar.

Figure 1A:
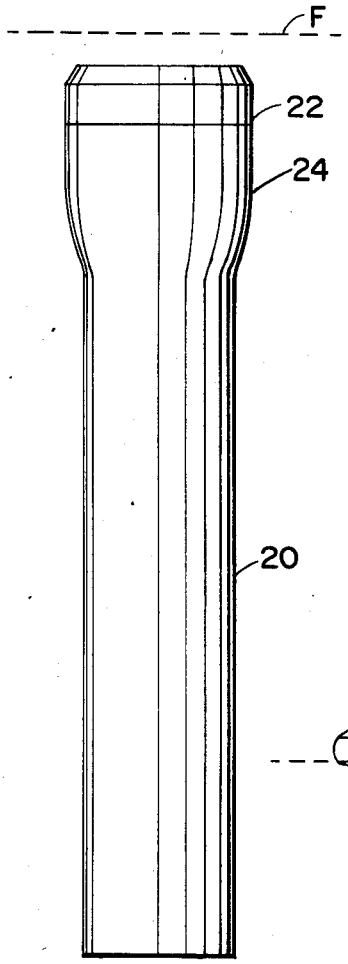
FIGS. 1A–1D are views of the blank spike at different stages in the known formation process.
Figure 1C:
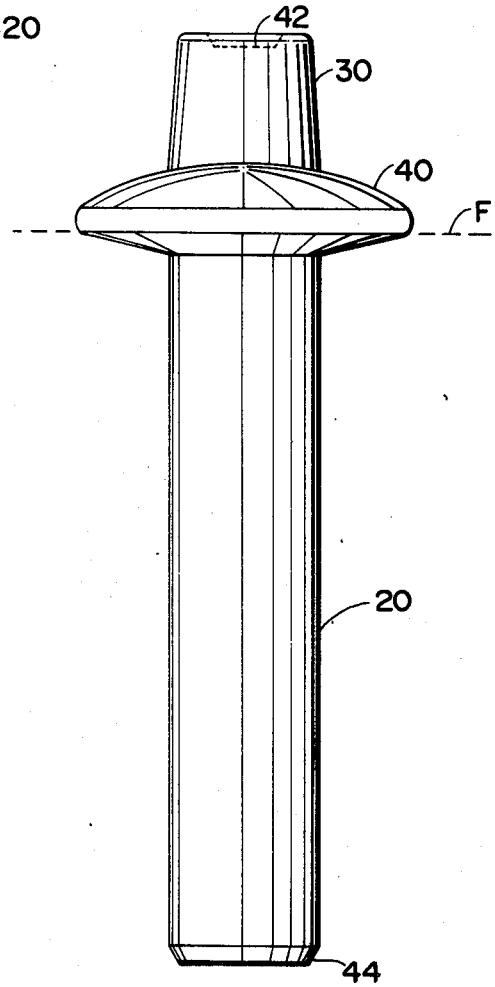

The first stage spike of FIG. 2A is significantly different from the first stage spike illustrated in FIG. 1A in connection with the known formation process. In the inventive method, the squared head 52 is essentially formed in its final shape prior to passing through the subsequent dies. In contrast to the known method, the wire is introduced into the first die to form the first stage spike of FIG. 1A which has a round, flat head. This head is then bumped up by introduction into a second die to form a rough squared end above the bulge section. A third die finishes or smoothes the rough squared end.

In addition, the first stage spike in accordance with the present invention includes a thicker cylindrical shank which is not upset by the punch in the first die. That is, the diameter of the upper portion 56 of the shank is sufficient for forming the collar in the later dies and is not modified or worked prior to being upset to form the collar. In contrast, the known first stage spike is upset to increase its diameter in the tapered portion to a diameter sufficient to form the collar.

The first stage spike 50 is introduced into a second cold forming die to form the second stage spike 60 illustrated in FIG. 2B. From the shape illustrated in FIG. 2A, the lower portion 58 of the shank of the first stage spike is reduced in diameter to form a reduced diameter portion 62. More specifically, the diameter of the lower portion 58 of the first stage shank is reduced from about 1.117 inches to about 0.906 inches in the second stage. In addition, the lower portion 58 of the first stage spike is lengthened during the diameter-reducing operation from about 3.263 inches to about 4.51 inches. The upper portion 64 of the second stage shank 60 is maintained at approximately the same diameter and length as that of the first stage. The squared head 52 of the spike is not modified by the second die.

Figure 1B:
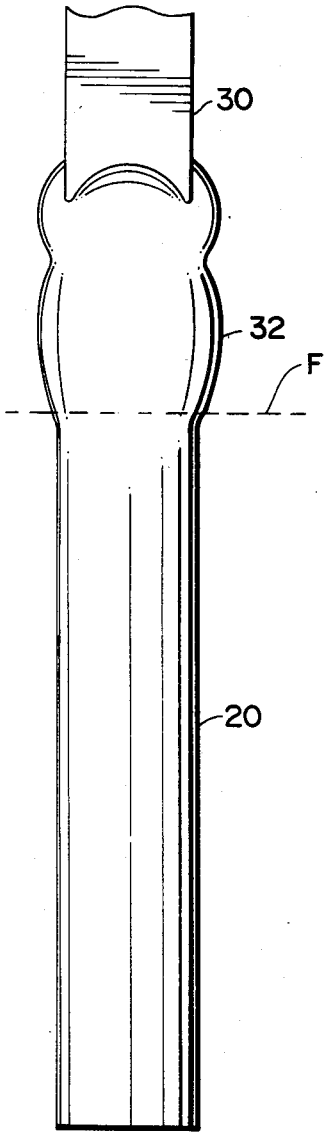
Figure 1D:
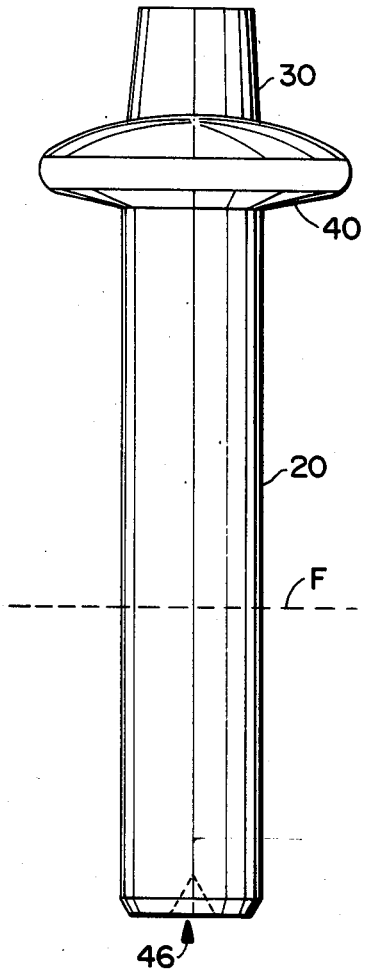

The second stage spike illustrated in FIG. 2B is significantly different from the known second stage spike illustrated in FIG. 1B. In the known second stage spike, the squared end is formed from the head of the first stage spike. In the inventive second stage, the head is not modified from its shape in the first stage, thus reducing the likelihood of fractures from overworking the material which forms the head. Further, the known second stage spike includes the bulge section which was built-up from upsetting the head of the known first stage spike. The building-up of the bulge section overworks the material in that section. In contrast, the inventive second stage has an upper portion which has not been modified significantly from its initial diameter.

Figure 2C:
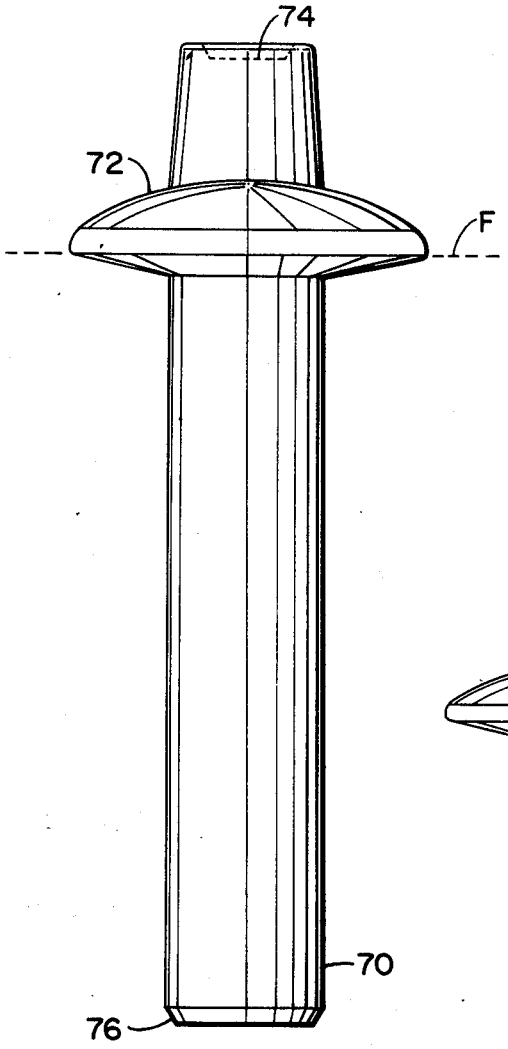
Figure 3:
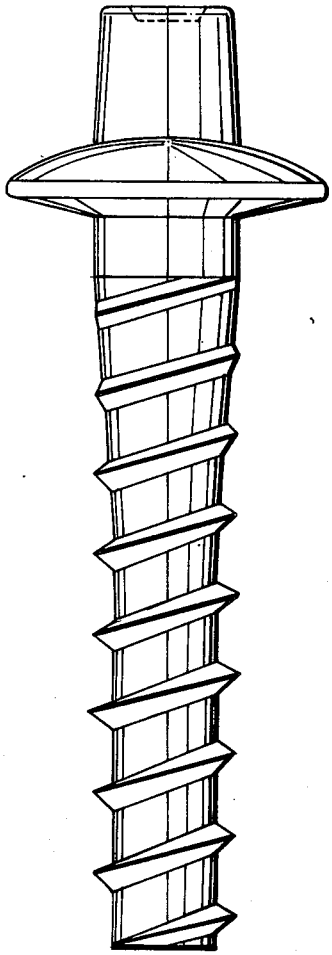
FIG. 3 is a view of the spike after threads are cut on the blank spike formed in accordance with the method illustrated in FIGS. 2A–2D.

The second stage spike 60 illustrated in FIG. 2B is introduced into a third cold forming die to form the third stage spike 70 illustrated in FIG. 2C. In the third stage, the upper portion 64 of the second stage shank 60 is compressed to form a collar 72. In addition, the third die may form a depression 74 in the squared head and the underfill area 76 at the base of the shank.

The third stage spike is similar to the third stage spike in the known formation process. However, the method of obtaining the third stage spike is quite different. In particular, in the known formation process, the head and bulge section are built-up from the tapered section in the second stage die with the bulge section being subsequently compressed in the third stage die to form the collar and finish the head. This operation overworked the head and collar. In the inventive method, the head is formed on the spike after passing through the first die. Moreover, the upper portion of the spike in the first stage is the portion of the spike which is compressed to form the collar. Accordingly, the inventive method forms the spike without building-up an area to form the collar and without significant modification of the head in the third stage.

Figure 2D:
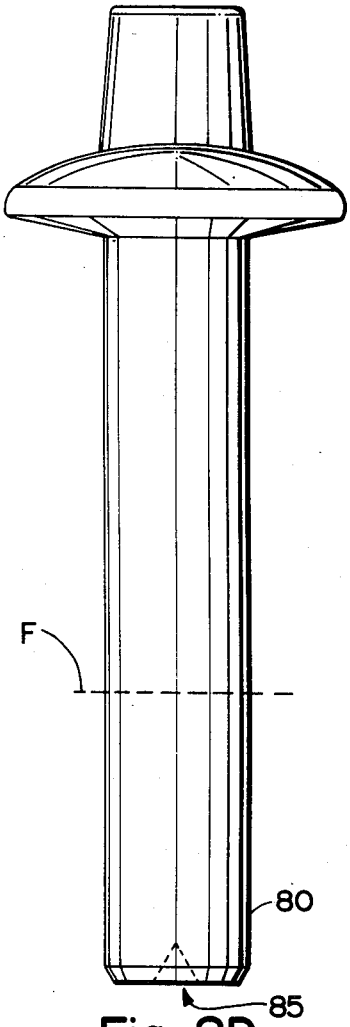

The third stage spike 70 may be introduced into a fourth cold forming die to form the fourth stage spike 80 illustrated in FIG. 2D. In the fourth die, a conical center cut 85 may be formed in the base of the shank to facilitate gripping of the spike during subsequent tapering and threading operations. The fourth stage operation is essentially the same as the fourth stage operation of the known formation process.

The inventive method has significant advantages from the known method. In the present invention, the first stage spike is formed with the squared head essentially in its final form. Therefore, fracture and/or cracks are not created in the head/collar area by the cold forming dies due to overworking the head. Further, the shank is not built-up to create the bulge section and then compressed to form the collar as in the known method. To the contrary, the portion which eventually forms the collar is formed from the upper portion of the first stage shank. The upper portion is not significantly modified until introduction into the third die to form the collar.

In the preferred embodiment, the collar has a diameter between about 2.0 and about 2.047 inches. The portion of the spike which forms the collar is the upper portion of the wire upon introduction into the first die. The upper portion of the wire is not worked or built-up prior to its formation into the collar so that the wire must have a diameter sufficient to form the collar. As noted herein, the wire size is determined by the desired "across corners" dimension of the squared end. The maximum wire size is preferaby used to create a two inch diameter collar. Applicants have determined that a wire of about 1.117 inches is sufficient to form both the squared end and collar with the preferred dimensions.

The method of forming a blank spike in accordance with the present invention provides a drastic increase in acceptable spikes. In the known method, only about 65% of the spikes were acceptable for the thread forming operation. The inventive method provides an acceptance rate of about 90–95%. The present invention is thus significantly more economical than the known method.

The principles, preferred embodiments and modes of operation of the present invention have been described in the foregoing specification. The invention which is to be protected herein, however, is not to be construed as limited to the particular forms disclosed, since these are to be regarded as illustrative rather than restrictive. Variations and changes may be made by those skilled in the art without departing from the spirit of the invention. Accordingly, it is expressly intended that all such variations and changes which fall within the spirit and scope of the present invention as defined in the claims be embraced thereby.

What is claimed is:

1. A method for forming a cylindrical workpiece having a first diameter into a blank spike which is subsequently provided with threads, said method comprising the steps of:

introducing the workpiece into a first die and forming in said first die a first stage spike having a cylindrical shank and a tool receiving end, said shank having upper and lower portions of said first diameter;

introducing the first stage spike into a second die and forming a second stage spike in said second die by reducing the lower portion of the shank of the first stage spike to a second diameter less than the first diameter of the upper portion of the shank while maintaining said upper shank portion unworked during said second die forming step; and introducing the second stage spike into a third die and forming a third stage spike in said third die by compressing the upper portion of the shank of the second stage spike to form a collar between said tool receiving end and said lower portion of said shank.

2. The method of claim 1 further comprising the step of introducing the third stage spike into a fourth die and forming fourth stage spike in said fourth die having holding means for gripping the spike in a thread forming apparatus.

3. The method of claim 1 wherein said first, second and third dies are cold forming dies.

4. The method of claim 1 wherein said tool receiving end of said first stage spike is maintained in essentially the same shape after introduction into said second and third stage dies.

5. The method of claim 4 wherein said tool receiving end of said first stage spike is a squared head.

6. The method of claim 1 wherein the steps of reducing the diameter of the lower portion of the shank of the first stage spike includes lengthening of the lower portion in the second die.

7. The method of claim 1 wherein the lower portion of the third stage spike is maintained at substantially the same diameter as the lower portion of the second stage spike.

8. The method of claim 1 wherein the collar formed by the third stage die has a circular cross-section.

9. The method of claim 8 wherein the first diameter is determined by the desired dimensions of the tool receiving end, the first diameter being of a size sufficient to form the collar.

10. The method of claim 1 wherein the first diameter is about 1.117 inches.

11. The method of claim 1 wherein the diameter of the collar is about 2.0 to 2.047 inches.

12. A method for forming a cylindrical bar into a blank spike having a squared head, a cylindrical shank extending from said head, and a collar located between said head and shank, said method comprising the steps of:

introducing said bar into a first cold forming die and forming a first stage spike in said first die having a cylindrical shank and a squared tool receiving end, said shank having upper and lower portions of a first diameter equal to the diameter of said bar;

introducing the first stage spike into a second cold forming die and forming a second stage spike in said second die by reducing the lower portion of the shank of the first stage spike in diameter upon introduction into the second cold forming die to a second diameter less than the first diameter of the upper portion of the shank while maintaining said upper shank portion unworked, and further maintaining the squared tool receiving end of said first stage spike in essentially the same shape as a tool receiving end of said second stage spike during said second die forming step; and introducing the second stage spike into a third cold forming die and forming a third stage spike in said third die by compressing the upper portion of the shank to form the collar between a lower portion of the third stage spike and the squared tool receiving end, while maintaining a lower portion of the third stage spike at substantially the same diameter as the lower portion of the second stage spike.

13. The method of claim 12 further comprising the steps of introducing the third stage spike into a fourth cold forming die and forming a fourth stage spike in said fourth die having a recess at a lower end of the shank for holding the spike in a thread forming apparatus.

14. The method of claim 12 wherein said tool receiving end of said first stage spike is maintained in essentially the same shape as said head of said blank spike after introduction into said first, second and third dies.

15. The method of claim 12 wherein said second diameter generally equals the diameter of the shank of the blank spike.

* * * * *